US010078982B2

(12) United States Patent
Moon et al.

(10) Patent No.: US 10,078,982 B2
(45) Date of Patent: Sep. 18, 2018

(54) APPARATUS AND METHOD OF DETERMINING DRIVING VOLTAGE

(71) Applicant: Samsung Display Co., Ltd., Yongin-si (KR)

(72) Inventors: Changyun Moon, Yongin-si (KR); Wonju Shin, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 56 days.

(21) Appl. No.: 15/130,855

(22) Filed: Apr. 15, 2016

(65) Prior Publication Data

US 2016/0372051 A1 Dec. 22, 2016

(30) Foreign Application Priority Data

Jun. 19, 2015 (KR) ..... 10-2015-0087590

(51) Int. Cl.
*G09G 3/30* (2006.01)
*G09G 3/3233* (2016.01)

(52) U.S. Cl.
CPC ... *G09G 3/3233* (2013.01); *G09G 2320/0242* (2013.01); *G09G 2320/0666* (2013.01); *G09G 2320/0693* (2013.01); *G09G 2330/021* (2013.01); *G09G 2360/145* (2013.01)

(58) Field of Classification Search
CPC ..... G09G 2320/0242; G09G 2320/0666
USPC ..... 345/76–86
See application file for complete search history.

(56) References Cited

U.S. PATENT DOCUMENTS 7,772,788 B2 * 8/2010 Park ..... G09G 3/3413 315/151
9,767,737 B2 * 9/2017 Son ..... G09G 3/3413
2008/0231589 A1 * 9/2008 So ..... G09G 3/3413 345/102
2008/0246702 A1 10/2008 Lee et al.
2008/0266216 A1 * 10/2008 Choi ..... G09G 3/3258 345/77
2009/0140972 A1 * 6/2009 Park ..... G02F 1/133609 345/102
2010/0103203 A1 4/2010 Choi
(Continued)

FOREIGN PATENT DOCUMENTS

KR 10-2008-0090879 10/2008
KR 10-2010-0045055 5/2010
(Continued)

*Primary Examiner* — Roy P Rabindranath
(74) *Attorney, Agent, or Firm* — Lewis Roca Rothgerber Christie LLP

(57) ABSTRACT

An apparatus to determine a driving voltage includes: a color coordinate value comparator to measure a color coordinate value of an organic light-emitting display apparatus, to calculate a difference value between the measured color coordinate value and a fiducial color coordinate value, and to compare the calculated difference value with a first critical value; a voltage level changer to increase an absolute value of a driving voltage applied to each pixel of the organic light-emitting display apparatus when the difference value is greater than or equal to the first critical value; and a voltage level determiner to determine a level of the driving voltage at a point of time when the difference value is calculated as a final level of a driving voltage, when the difference value is less than the first critical value.

20 Claims, 4 Drawing Sheets

(56) References Cited

U.S. PATENT DOCUMENTS

| | | | | |
|---|---|---|---|---|
| 2010/0259527 | A1* | 10/2010 | Odawara | G09G 3/3233 345/211 |
| 2011/0025676 | A1 | 2/2011 | Kawashima | |
| 2012/0044271 | A1 | 2/2012 | Lee et al. | |
| 2012/0169704 | A1 | 7/2012 | Chung | |
| 2013/0235010 | A1* | 9/2013 | Park | H05B 33/0815 345/209 |

FOREIGN PATENT DOCUMENTS

| | | |
|---|---|---|
| KR | 10-2011-0012274 | 2/2011 |
| KR | 10-2012-0017734 | 2/2012 |
| KR | 10-2012-0079364 | 7/2012 |

* cited by examiner

APPARATUS AND METHOD OF DETERMINING DRIVING VOLTAGE

CROSS-REFERENCE TO RELATED APPLICATION

This application claims priority to and the benefit of Korean Patent Application No. 10-2015-0087590, filed on Jun. 19, 2015, in the Korean Intellectual Property Office, the disclosure of which is incorporated herein in its entirety by reference.

BACKGROUND

1. Field

One or more aspects of exemplary embodiments relate to an apparatus and a method of determining a driving voltage.

2. Description of the Related Art

In general, an organic light-emitting display apparatus includes a plurality of organic light-emitting devices that emit light when electric current flows through the organic light-emitting devices. In order to adjust the amount of electric current flowing through the organic light-emitting devices, each of the organic light-emitting devices includes a pixel circuit. According to a level of a driving voltage and a level of a voltage of a data signal that are applied to the pixel circuit, the intensity of light emitted by the corresponding organic light-emitting device connected to the pixel circuit is determined.

In such an operation of an organic light-emitting display apparatus, a driving voltage includes a first driving voltage (for example, ELVDD) and a second driving voltage (for example, ELVSS), and a level of the driving voltage applied to each pixel circuit and organic light-emitting device is determined based on a difference between a level of the first driving voltage and a level of the second driving voltage. When a level of a driving voltage applied to the pixel circuit and the organic light-emitting device is too low, the organic light-emitting display apparatus may have a defect, such as color shift. When the level of the driving voltage is higher than desired, power consumption to operate the organic light-emitting display apparatus may excessively increase.

Information disclosed in this Background section is only for enhancement of understanding of the background of the inventive concept, and therefore, it may contain information that does not constitute prior art.

SUMMARY

One or more aspects of exemplary embodiments relate to an apparatus and method of determining a driving voltage, wherein a level of the driving voltage suitable for an organic light-emitting display apparatus is determined based on a degree by which a color coordinate value changes according to a level of a driving voltage and a data signal that are applied to pixels of the organic light-emitting display apparatus.

One or more exemplary embodiments include an apparatus and method of determining a driving voltage, whereby a defect such as producing an abnormal color is prevented or substantially prevented in an organic light-emitting display apparatus, and excessive increase in power consumption to operate the organic light-emitting display apparatus is prevented or substantially prevented.

One or more exemplary embodiments include an apparatus and method of determining a driving voltage, wherein a degree by which a color coordinate value changes according to a change in a level of a driving voltage applied to an organic light-emitting display apparatus is measured to prevent or reduce a defect, such as producing an abnormal color in the organic light-emitting display apparatus, and to prevent or substantially prevent excessive increase in power consumption to operate the organic light-emitting display apparatus.

Additional features and aspects will be set forth in part in the description which follows, and in part, will be apparent from the description, or may be learned by practice of the presented embodiments.

According to one or more exemplary embodiments, an apparatus for determining a driving voltage includes: a color coordinate value comparator configured to measure a color coordinate value of an organic light-emitting display apparatus, to calculate a difference value between the measured color coordinate value and a fiducial color coordinate value, and to compare the calculated difference value with a first critical value; a voltage level changer configured to increase an absolute value of a driving voltage applied to each pixel of the organic light-emitting display apparatus when the difference value is greater than or equal to the first critical value, in order to supply driving current to the pixels; and a voltage level determiner configured to determine a level of the driving voltage at a point of time when the difference value is calculated as a final level of the driving voltage of the organic light-emitting display apparatus, when the difference value is less than the first critical value.

The apparatus may further include an initial voltage level setter configured to set a first fiducial voltage value as an initial level of the driving voltage of the organic light-emitting display apparatus, and to adjust a voltage level of a data signal supplied to the pixels such that the color coordinate value of the organic light-emitting display apparatus is the same as the fiducial color coordinate value.

The initial voltage level setter may be configured to set a second fiducial voltage value as a level of the driving voltage of the organic light-emitting display apparatus when the color coordinate value of the organic light-emitting display apparatus is set to be the same as the fiducial color coordinate value.

The color coordinate value comparator may include: a color coordinate value initial comparator configured to measure a color coordinate value of the organic light-emitting display apparatus when the second fiducial voltage value is set as the level of the driving voltage of the organic light-emitting display apparatus; and a color coordinate value repetitive comparator configured to measure a color coordinate value of the organic light-emitting display apparatus when the level of the driving voltage is changed by the voltage level changer.

The voltage level determiner may be further configured to modify the level of the driving voltage at a point of time when the difference value is calculated by taking into account at least one of a degradation margin and a dispersion margin of the organic light-emitting display apparatus, and to determine the modified level of the driving voltage as the final level of the driving voltage of the organic light-emitting display apparatus, when the difference value is less than the first critical value.

The voltage level determiner may be further configured to determine the degradation margin by taking into account at least one of a length of time during which the organic light-emitting display apparatus is driven, a color of each of the pixels of the organic light-emitting display apparatus, and a constituent of each of the pixels of the organic light-emitting display apparatus.

The voltage level determiner may be further configured to determine the dispersion margin by taking into account at least one of a thickness of an organic layer of the organic light-emitting display apparatus, a thickness of an electrode of the organic light-emitting display apparatus, and a process of manufacturing the organic light-emitting display apparatus.

The apparatus may further include a voltage level recorder configured to record the determined level of the driving voltage on a register of a source driver of the organic light-emitting display apparatus.

The apparatus may further include a defect determiner configured to determine that the organic light-emitting display apparatus is defective, when the determined level of the driving voltage is higher than a second critical value.

The organic light-emitting display apparatus may include a plurality of organic light-emitting display apparatuses, and the voltage level determiner may be configured to determine a level of the driving voltage independently for each of the organic light-emitting display apparatuses.

According to one or more exemplary embodiments, a method of determining a level of a driving voltage of an organic light-emitting display apparatus includes: measuring a color coordinate value of the organic light-emitting display apparatus; calculating a difference value between the measured color coordinate value and a fiducial color coordinate value; comparing the calculated difference value with a first critical value; increasing an absolute value of the driving voltage applied to each pixel of the organic light-emitting display apparatus, when the difference value is equal to or greater than the first critical value, in order to supply driving current to the pixels; and determining a level of the driving voltage at a point of time when the difference value is calculated as a final level of the driving voltage of the organic light-emitting display apparatus, when the difference value is less than the first critical value.

The method may further include setting a first fiducial voltage value as an initial level of the driving voltage of the organic light-emitting display apparatus, and adjusting a voltage level of a data signal supplied to the pixels such that the color coordinate value of the organic light-emitting display apparatus is the same as the fiducial color coordinate value, before the comparing of the calculated difference value with the first critical value.

The adjusting of the voltage level of the data signal supplied to the pixels may include setting a second fiducial voltage value as a level of the driving voltage of the organic light-emitting display apparatus when the color coordinate value of the organic light-emitting display apparatus is set to be the same as the fiducial color coordinate value.

The measuring of the color coordinate value of the organic light-emitting display apparatus may further include: measuring a color coordinate value of the organic light-emitting display apparatus when the second fiducial voltage value is set as the level of the driving voltage of the organic light-emitting display apparatus; and measuring a color coordinate value of the organic light-emitting display apparatus when the level of the driving voltage is changed by the increasing of the absolute value of the driving voltage.

The determining of the level of the driving voltage may include: modifying the level of the driving voltage at the point of time when the difference value is calculated by taking into account at least one of a degradation margin and a dispersion margin of the organic light-emitting display apparatus; and determining the modified level of the driving voltage as the final level of the driving voltage of the organic light-emitting display apparatus.

The determining of the level of the driving voltage may further include determining the degradation margin by taking into account at least one of a length of time during which the organic light-emitting display apparatus is driven, a color of each of the pixels of the organic light-emitting display apparatus, and a constituent of each of the pixels of the organic light-emitting display apparatus.

The determining of the level of the driving voltage may further include determining the dispersion margin by taking into account at least one of a thickness of an organic layer of the organic light-emitting display apparatus, a thickness of an electrode of the organic light-emitting display apparatus, and a process of manufacturing the organic light-emitting display apparatus.

The method may further include recording the determined level of the driving voltage on a register of a source driver of the organic light-emitting display apparatus, after the determining of the level of the driving voltage.

The method may further include determining that the organic light-emitting display apparatus is defective after the determining of the level of the driving voltage, when the determined level of the driving voltage is higher than a second critical value.

The determining of the level of the driving voltage may include determining the level of the driving voltage independently for each of a plurality of organic light-emitting display apparatuses.

BRIEF DESCRIPTION OF THE DRAWINGS

These and/or other aspects and features will become apparent and more readily appreciated from the following description of the exemplary embodiments, taken in conjunction with the accompanying drawings in which.

DETAILED DESCRIPTION

Figure 1:
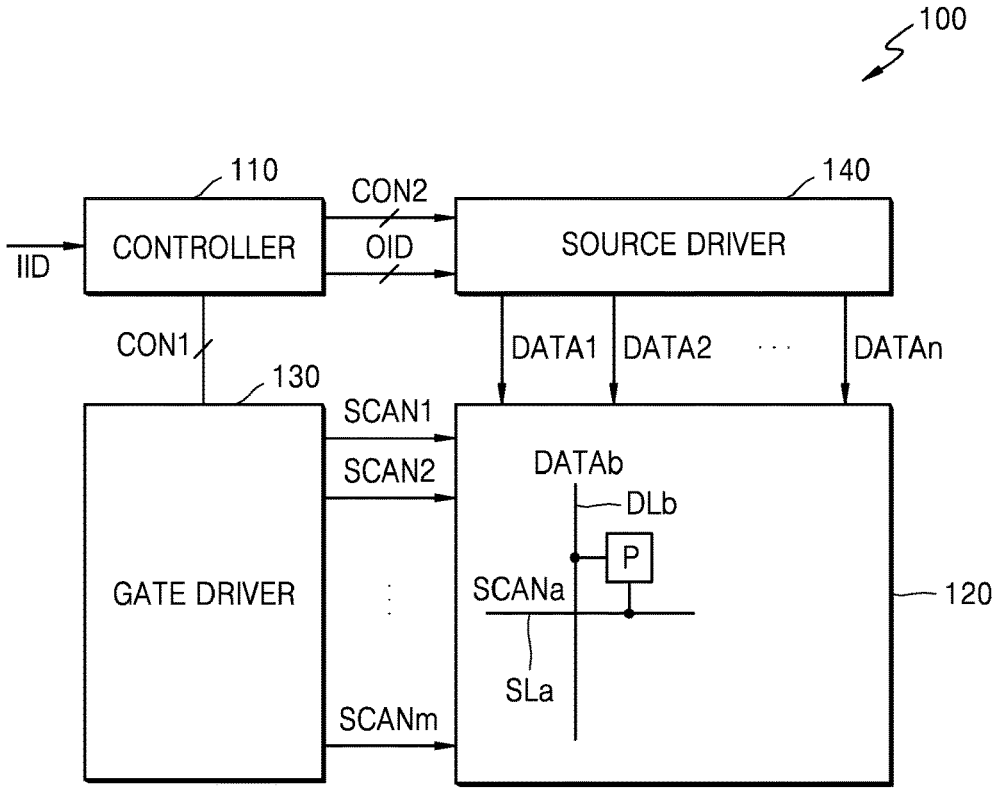
FIG. 1 schematically illustrates an organic light-emitting display apparatus included in a system for determining a driving voltage, according to an exemplary embodiment.

Hereinafter, exemplary embodiments will be described in more detail with reference to the accompanying drawings. The present inventive concept, however, may be embodied in various different forms, and should not be construed as being limited to only the illustrated embodiments herein. Rather, these embodiments are provided as examples so that this disclosure will be thorough and complete, and will fully convey the aspects and features of the inventive concept to those skilled in the art. Accordingly, processes, elements, and techniques that are not necessary to those having ordinary skill in the art for a complete understanding of the aspects and features of the inventive concept may not be described. Unless otherwise noted, like reference numerals denote like elements throughout the attached drawings and the written description, and thus, descriptions thereof may not be repeated.

In the drawings, the relative sizes of elements, layers, and regions may be exaggerated for clarity. Spatially relative terms, such as "beneath," "below," "lower," "under," "above," "upper," and the like, may be used herein for ease of explanation to describe one element or feature's relationship to another element(s) or feature(s) as illustrated in the figures. It will be understood that the spatially relative terms are intended to encompass different orientations of the device in use or in operation, in addition to the orientation depicted in the figures. For example, if the device in the figures is turned over, elements described as "below" or "beneath" or "under" other elements or features would then be oriented "above" the other elements or features. Thus, the example terms "below" and "under" can encompass both an orientation of above and below. The device may be otherwise oriented (e.g., rotated 90 degrees or at other orientations) and the spatially relative descriptors used herein should be interpreted accordingly.

It will be understood that, although the terms "first," "second," "third," etc., may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section described below could be termed a second element, component, region, layer or section, without departing from the spirit and scope of the present inventive concept.

It will be understood that when an element or layer is referred to as being "on," "connected to," or "coupled to" another element or layer, it can be directly on, connected to, or coupled to the other element or layer, or one or more intervening elements or layers may be present. In addition, it will also be understood that when an element or layer is referred to as being "between" two elements or layers, it can be the only element or layer between the two elements or layers, or one or more intervening elements or layers may also be present.

The terminology used herein is for the purpose of describing particular embodiments only and is not intended to be limiting of the inventive concept. As used herein, the singular forms "a" and "an" are intended to include the plural forms as well, unless the context clearly indicates otherwise. It will be further understood that the terms "comprises," "comprising," "includes," and "including," when used in this specification, specify the presence of the stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Expressions such as "at least one of," when preceding a list of elements, modify the entire list of elements and do not modify the individual elements of the list.

As used herein, the term "substantially," "about," and similar terms are used as terms of approximation and not as terms of degree, and are intended to account for the inherent variations in measured or calculated values that would be recognized by those of ordinary skill in the art. Further, the use of "may" when describing embodiments of the present inventive concept refers to "one or more embodiments of the present inventive concept." As used herein, the terms "use," "using," and "used" may be considered synonymous with the terms "utilize," "utilizing," and "utilized," respectively. Also, the term "exemplary" is intended to refer to an example or illustration.

The electronic or electric devices and/or any other relevant devices or components according to embodiments of the inventive concept described herein may be implemented utilizing any suitable hardware, firmware (e.g. an application-specific integrated circuit), software, or a combination of software, firmware, and hardware. For example, the various components of these devices may be formed on one integrated circuit (IC) chip or on separate IC chips. Further, the various components of these devices may be implemented on a flexible printed circuit film, a tape carrier package (TCP), a printed circuit board (PCB), or formed on one substrate. Further, the various components of these devices may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device, or the functionality of a particular computing device may be distributed across one or more other computing devices without departing from the spirit and scope of the exemplary embodiments of the inventive concept.

Unless otherwise defined, all terms (including technical and scientific terms) used herein have the same meaning as commonly understood by one of ordinary skill in the art to which the present inventive concept belongs. It will be further understood that terms, such as those defined in commonly used dictionaries, should be interpreted as having a meaning that is consistent with their meaning in the context of the relevant art and/or the present specification, and should not be interpreted in an idealized or overly formal sense, unless expressly so defined herein.

FIG. 1 schematically illustrates an organic light-emitting display apparatus 100 included in a system for determining a driving voltage, according to an exemplary embodiment of the present invention.

Referring to FIG. 1, the organic light-emitting display apparatus 100 according to one or more exemplary embodiments may include a controller 110, a display unit 120, a gate driver 130, and a source driver 140. The controller 110, the gate driver 130, and the source driver 140 may be respectively formed on separate semiconductor chips, or may be integrated on one semiconductor chip. In some embodiments, the controller 110, the gate driver 130, and/or the source driver 140 may be formed on the same substrate as the display unit 120.

The organic light-emitting display apparatus 100 may display an image through a pixel P. The organic light-emitting display apparatus 100 may be, for example, an electronic apparatus itself, such as a smartphone, a tablet personal computer (PC), a laptop PC, a monitor, and/or a television (TV), and/or may be a part (e.g., a component) of an electronic device for displaying an image.

The pixel P may include a plurality of sub-pixels for respectively displaying a plurality of colors in order to display various colors. The pixel P herein may mainly refer to one sub-pixel. However, the present invention is not limited thereto, and the pixel P may refer to one unit pixel including a plurality of sub-pixels. That is, although it is described herein that one pixel P is present, it may be construed as meaning that one sub-pixel is present, or it may be construed as meaning that a plurality of sub-pixels constituting one unit pixel are present.

The pixel P may include a light-emitting device E and a pixel circuit PC. A driving voltage and a data signal may be applied to the pixel circuit PC, and the pixel circuit PC may output driving current to the light-emitting device E. In this regard, the driving voltage may include a first driving voltage ELVDD and a second driving voltage ELVSS. The first driving voltage ELVDD may be a relatively high driving voltage, and the second driving voltage ELVSS may be a relatively low driving voltage. A level of a voltage supplied to each pixel P may be a difference between a level of the first driving voltage ELVDD and a level of the second driving voltage ELVSS. For example, when the level of the first driving voltage ELVDD is 6(V) and the level of the second driving voltage ELVSS is −4(V), the level of the voltage supplied to each pixel P may be 10(V). As the level of the first driving voltage ELVDD increases, and the level of the second driving voltage ELVSS decreases, the level of the voltage supplied to each pixel P may increase.

The organic light-emitting display apparatus 100 may receive an input of a plurality of image frames from the outside. When the image frames are sequentially displayed, the image frames may be displayed as one moving picture. Each of the image frames may include input image data IID. The input image data IID may include information regarding luminance of light emitted through the pixel P, and a bit number of the input image data IID may be determined based on a determined luminance step (e.g., gray level). For example, when the number of luminance steps of the light emitted through the pixel P is 256, the input image data IID may be an 8-bit digital signal. When the darkest gray level that may be displayed by the display unit 120 is a first step, and the brightest gray level that may be displayed by the display unit 120 is a two hundred and fifty sixth step, input image data IID corresponding to the first step may be 0, and input image data IID corresponding to the two hundred and fifty sixth step may be 255. The darkest gray level that may be displayed by the display unit 120 may be referred to as a minimum grayscale value, and the brightest gray level that may be displayed by the display unit 120 may be referred to as a maximum grayscale value. The number of luminance steps of the light emitted through the pixel P may be variously determined, for example, 64 steps, 256 steps, 1024 steps, and/or the like.

The controller 110 may be connected to the display unit 120, the gate driver 130, and the source driver 140. The controller 110 may receive an input of input image data IID, and may output first control signals CON1 to the gate driver 130. The first control signals CON1 may include a horizontal synchronization signal (HSYNC). The first control signals CON1 may include control signals that are used for the gate driver 130 to output scan signals SCAN1 to SCANm synchronized with the HSYNC.

The controller 110 may output second control signals CON2 to the source driver 140. The controller 110 may output output image data OID to the source driver 140. The second control signals CON2 may include control signals that are used for the source driver 140 to output data signals DATA1 to DATAn corresponding to the output image data OID. The output image data OID may include image information that is used to generate the data signals DATA1 to DATAn. The output image data OID may be image data generated by correcting the input image data IID received from the outside.

The display unit 120 may include a plurality of pixels, a plurality of scan lines, and a plurality of data lines. Each of the plurality of scan lines may be connected to a corresponding row of pixels from among the plurality of pixels. Each of the plurality of data lines may be connected to a corresponding column of pixels from among the plurality of pixels. For example, as illustrated in FIG. 1, the display unit 120 may include the pixel P included in the plurality of pixels. In this regard, the pixel P may be a pixel arranged in an a-th row and a b-th column of the display unit 120. In this case, the display unit 120 may include an a-th scan line SLa connected to each of the pixels positioned in the a-th row, and a b-th data line DLb connected to each of the pixels positioned in the b-th column. Thus, the pixel P may be connected to the a-th scan line SLa and the b-th data line DLb.

The gate driver 130 may output scan signals SCAN1 to SCANm to the scan lines. The gate driver 130 may be synchronized with the HSYNC and/or a vertical synchronization signal (VSYNC) to output the scan signals SCAN1 to SCANm.

The source driver 140 may be synchronized with the scan signals SCAN1 to SCANm to output the data signals DATA1 to DATAn to the data lines. The source driver 140 may receive the output image data OID as an input, and may output, to the data lines, the data signals DATA1 to DATAn proportional to the output image data OID.

Figure 2:
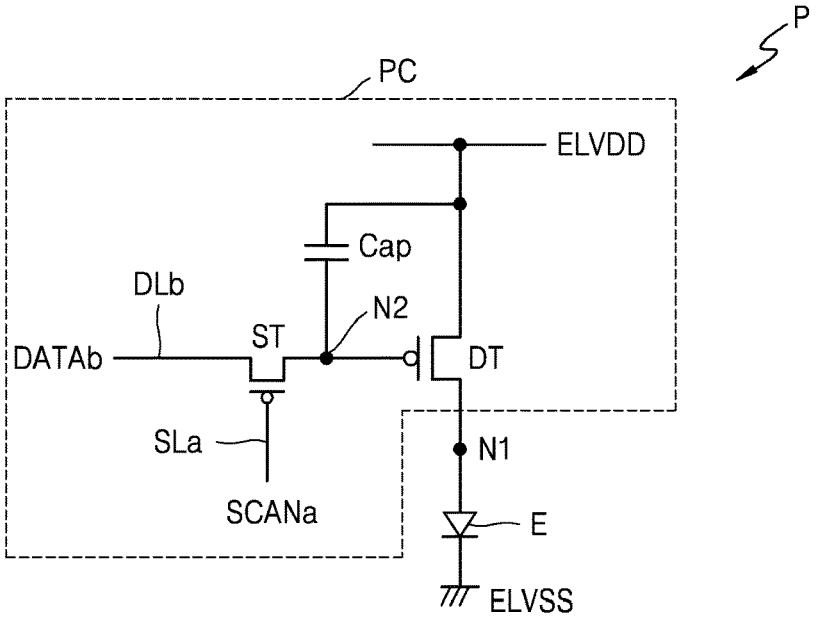
FIG. 2 schematically illustrates an example of a structure of a pixel included in the organic light-emitting display apparatus of FIG. 1.

FIG. 2 schematically illustrates an example of a structure of the pixel P included in the organic light-emitting display apparatus 100 of FIG. 1.

Referring to FIG. 2, the pixel P may include a pixel circuit PC and a light-emitting device E. The pixel circuit PC of the pixel P may include a driving transistor DT, a switching transistor ST, and a storage capacitor Cap.

The pixel P in FIG. 2 is shown as being arranged in an a-th row and a b-th column of the display unit 120. In this case, the a-th scan line SLa and the b-th data line DLb may be connected to the pixel P. Also, an a-th scan signal SCANa, which determines timing for applying respective data signals to the pixels P positioned in the a-th row, may be applied to the pixel P. A b-th data signal DATAb, which determines the grayscale values (or gray levels) of the pixels P positioned in the b-th column, may be applied to the pixel P.

The first driving voltage ELVDD and the second driving voltage ELVSS may be applied to the pixel P. The first driving voltage ELVDD may be a high-level voltage (e.g., a predetermined high-level voltage), and the second driving voltage ELVSS may be a voltage having a lower level than that of the first driving voltage ELVDD.

The driving transistor DT may be connected between a first driving voltage ELVDD terminal and a first node N1, and may be controlled by a voltage level of a second node N2. The first driving voltage ELVDD terminal may be a terminal for supplying the first driving voltage ELVDD that is supplied from a power supply unit (e.g., a power supply or a power source), which may be located inside or outside the organic light-emitting display apparatus 100, to each pixel P of the display unit 120. The driving transistor DT may output driving current to the first node N1, based on a voltage level of a data signal that is input to the pixel circuit PC.

The switching transistor ST may be connected between the b-th data line DLb and the second node N2, and may be controlled by the a-th scan signal SCANa applied to the a-th scan line SLa. The switching transistor ST may determine timing based on the a-th scan signal SCANa for charging the storage capacitor Cap with a voltage corresponding to a data voltage.

The storage capacitor Cap may be connected between the first driving voltage ELVDD terminal and the second node N2. The storage capacitor Cap may store electric charges corresponding to a difference between a voltage level of the first driving voltage ELVDD and a voltage level of the second node N2, so that a voltage level of a data signal that is input to the pixel circuit PC via the b-th data line DLb may be maintained or substantially maintained.

The light-emitting device E may have an anode connected to the first node N1 and a cathode connected to a second driving voltage ELVSS terminal. The light-emitting device E may be a device that emits light at a luminance corresponding to the driving current, due to a difference between a voltage level applied to the anode and a voltage level applied to the cathode. In some embodiments, the light-emitting device E may be an organic light-emitting diode. That is, the pixel circuit PC may output driving current that is supplied to the anode of the light-emitting device E, based on a driving voltage and a data signal applied to the pixel circuit PC, and the light-emitting device E may be utilized to display an image on the organic light-emitting display apparatus 100 by emitting light corresponding to the driving current of the light-emitting device E.

Although it is illustrated in FIG. 2 that the pixel circuit PC has a structure including two transistors and one capacitor (2T1C), this is just an illustrative form of the pixel circuit PC. That is, the pixel circuit PC according to some exemplary embodiments may include various structures including one or more transistors, one or more capacitors, and other electronic devices, and also various kinds of circuits capable of adjusting a level of driving current supplied to the light-emitting device E based on a driving voltage and a data signal applied to its corresponding circuit.

Figure 3:
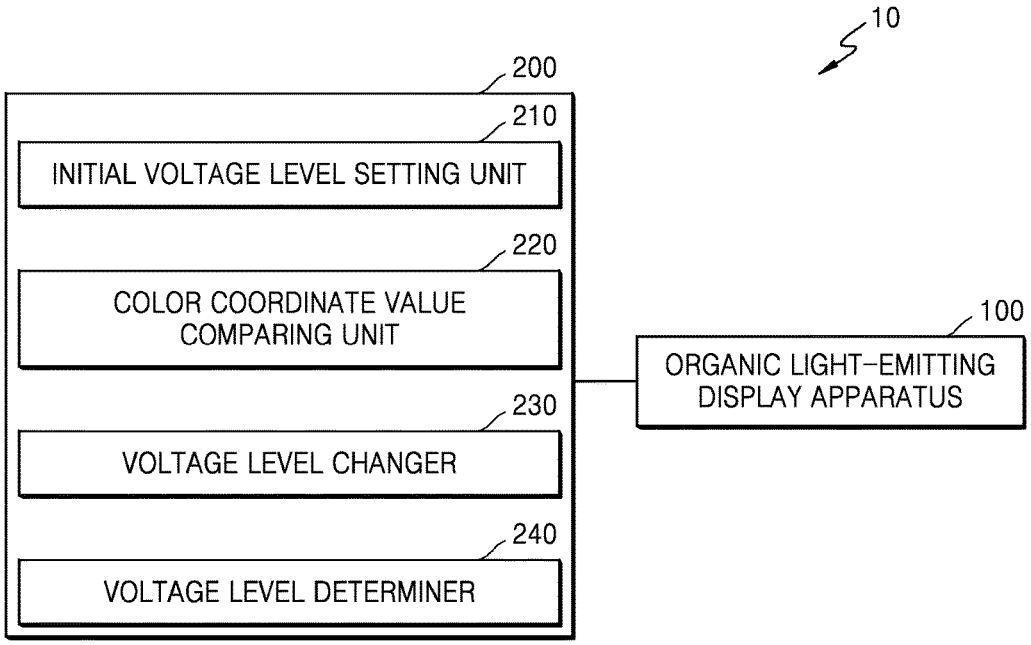
FIGS. 3 and 4 are block diagrams, each schematically illustrating a system for determining a driving voltage, according to exemplary embodiments.
Figure 4:
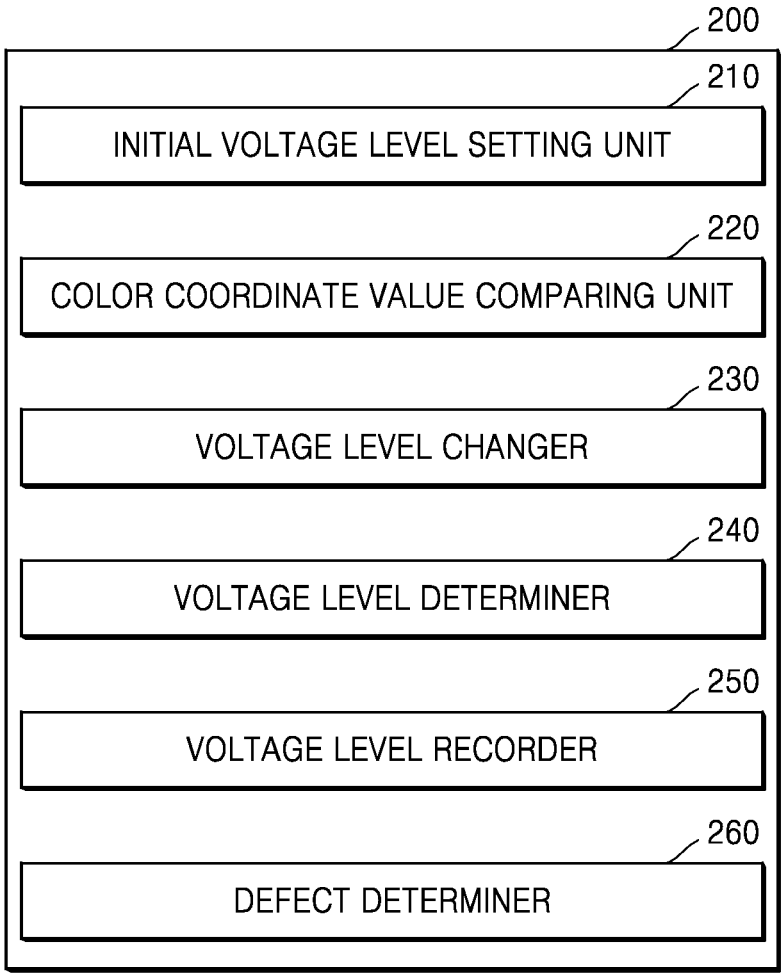

FIGS. 3 and 4 are block diagrams, each schematically illustrating a system for determining a driving voltage, according to one or more exemplary embodiments of the present invention.

Referring to FIG. 3, the system 10 for determining a driving voltage may include the organic light-emitting display apparatus 100 and a driving voltage determining apparatus 200. The driving voltage determining apparatus 200 may include an initial voltage level setting unit (e.g., an initial voltage level setter) 210, a color coordinate value comparing unit (e.g., a color coordinate value comparator) 220, a voltage level changer 230, and a voltage level determiner 240.

The initial voltage level setting unit 210 may determine an initial level of a driving voltage of the organic light-emitting display apparatus 100. The initial voltage level setting unit 210 may determine at least one of a level of the first driving voltage ELVDD and a level of the second driving voltage ELVSS. Hereinafter, for convenience of description, determining a level of a driving voltage supplied to the organic light-emitting display apparatus 100 by changing the level of the second driving voltage ELVSS will be described as an example, but the present invention is not limited thereto.

The initial voltage level setting unit 210 may set a first fiducial voltage value (e.g., a predetermined first fiducial voltage value) as a voltage level of the second driving voltage ELVSS. In this regard, the first fiducial voltage value may be a value that is small enough to not cause color shift in the organic light-emitting display apparatus 100. When a level of a driving voltage supplied to the pixel P of the organic light-emitting display apparatus 100 is not sufficiently high, a color in which color shift has occurred may be displayed through the pixel P, instead of a color intended by the data signal. In an embodiment, the initial voltage level setting unit 210 performs an operation of obtaining a fiducial color coordinate value under a condition where no color shift has occurred, and therefore, a level of the driving voltage is sufficiently high. For example, the level of the second driving voltage ELVSS may be set as a sufficiently low value. Accordingly, the first fiducial voltage value may be determined as a value that is small enough not to cause color shift in the organic light-emitting display apparatus 100.

When the first fiducial voltage value is set as the level of the second driving voltage ELVSS, the initial voltage level setting unit 210 may allow a voltage level of a data signal supplied to the pixels to be adjusted, such that a color coordinate value of the organic light-emitting display apparatus 100 is identical to or substantially the same as a fiducial color coordinate value. In this regard, the initial voltage level setting unit 210 may measure a color coordinate value of a position (e.g., a particular or predetermined position) in the organic light-emitting display apparatus 100 when an image pattern (e.g., a particular or predetermined image pattern) is displayed on the organic light-emitting display apparatus 100. For example, the initial voltage level setting unit 210 may measure a color coordinate value of the center of the organic light-emitting display apparatus 100 when a full white screen is displayed on the organic light-emitting display apparatus 100. In general, when a manufacturer of the organic light-emitting display apparatus 100 sells the organic light-emitting display apparatus 100 to a buyer, the buyer may request the manufacturer of the organic light-emitting display apparatus 100 to set the product, such that the organic light-emitting display apparatus 100 has a particular color coordinate value in a full white state. Accordingly, a process of displaying a full white screen on the organic light-emitting display apparatus 100, and adjusting a color coordinate value in this case to be identical to or substantially the same as a particular color coordinate value may be performed. Thus, the initial voltage level setting unit 210 may set a particular color coordinate value as the fiducial color coordinate value, may measure a color coordinate value of the center of the organic light-emitting display apparatus 100 when the full white screen is displayed, and may allow a level of the voltage of the data signal supplied to the pixels to be adjusted, such that the measured color coordinate value is identical to or substantially the same as the fiducial color coordinate value. In this regard, an apparatus which adjusts a level of the voltage of the data signal supplied to the pixels may be included in the initial voltage level setting unit 210, or may be an apparatus positioned outside of the driving voltage determining apparatus 200.

Under a condition where the color coordinate value of the organic light-emitting display apparatus 100 is set to be identical to or substantially the same as the fiducial color coordinate value, the initial voltage level setting unit 210 may set a second fiducial voltage value (e.g., a predetermined second fiducial voltage value) as the level of the second driving voltage ELVSS. In this regard, the second fiducial voltage value may be a level of an ideal target voltage that the organic light-emitting display apparatus 100 may have, or may be the lowest level of a voltage that may be expected where no color shift may occur in the organic light-emitting display apparatus 100. In an embodiment, the first fiducial voltage value is set so that no color shift occurs in the organic light-emitting display apparatus 100, and may be set to be lower than needed. When the first fiducial voltage value is continuously used as the level of the second driving voltage ELVSS, power consumption of the organic light-emitting display apparatus 100 may be excessive. Accordingly, when the level of the second driving voltage ELVSS is identical to or substantially the same as the first fiducial voltage value as set by the previous operation of the initial voltage level setting unit 210 to be the fiducial color coordinate value, the initial voltage level setting unit 210 may set the second fiducial voltage value to be higher than the first fiducial voltage value as the level of the second driving voltage ELVSS, and may measure a color coordinate value in this case.

The color coordinate value comparing unit 220 may measure a color coordinate value of the organic light-emitting display apparatus 100. Also, the color coordinate value comparing unit 220 may calculate a difference value between the measured color coordinate value and a fiducial color coordinate value. In addition, the color coordinate value comparing unit 220 may compare the calculated difference value with a first critical value (e.g., a predetermined first critical value).

The color coordinate value comparing unit 220 may measure a color coordinate value of the organic light-emitting display apparatus 100, calculate a difference between the measured color coordinate value and a fiducial color coordinate value, and check if the color shift occurs under the driving voltage currently being applied to the organic light-emitting display apparatus 100. That is, when a difference value between a color coordinate value measured by the color coordinate value comparing unit 220 and a fiducial color coordinate value is sufficiently small, no color shift may occur. It is desirable that no color shift occurs when the difference value between the measured color coordinate value and the fiducial color coordinate value is equal to or substantially equal to 0. However, in reality, the measured color coordinate value and the fiducial color coordinate value may not perfectly match, and equipment for measuring a color coordinate value may have an error. Accordingly, the first critical value may be determined as a value small enough to determine that no color shift occurs.

Under a condition where the color coordinate value of the organic light-emitting display apparatus 100 is set to be identical to or substantially the same as the fiducial color coordinate value, and the second fiducial voltage value is set as the level of the second driving voltage ELVSS, the color coordinate value comparing unit 220 may measure the color coordinate value of the organic light-emitting display apparatus 100, calculate a difference value between the measured color coordinate value and a fiducial color coordinate value, and compare the calculated difference value with a first critical value.

When a difference value calculated by the color coordinate value comparing unit 220 is greater than or equal to the first critical value, the voltage level changer 230 may change a level of a driving voltage applied to each pixel by as much as a predetermined change. That is, in the case that a level of the driving voltage supplied to the organic light-emitting display apparatus 100 is changed by changing a level of the second driving voltage ELVSS, when a difference value calculated by the color coordinate value comparing unit 220 is greater than or equal to the first critical value, the voltage level changer 230 may decrease the level of the second driving voltage ELVSS by as much as a predetermined change.

In an embodiment, the second fiducial voltage value may be a level of an ideal target voltage, and when the second fiducial voltage value is set as the level of the second driving voltage ELVSS, color shift may occur in the organic light-emitting display apparatus 100. Accordingly, when the difference value calculated by the color coordinate value comparing unit 220 is greater than or equal to the first critical value, the voltage level changer 230 may determine that color shift has occurred, and may decrease the level of the second driving voltage ELVSS by as much as a predetermined change.

The color coordinate value comparing unit 220 may include a color coordinate value initial comparison unit (e.g., a color coordinate value initial comparator) and a color coordinate value repetitive comparison unit (e.g., a color coordinate value repetitive comparator). The color coordinate value initial comparison unit may measure a color coordinate value of the organic light-emitting display apparatus 100 under a condition where the second fiducial voltage value is set as the level of the second driving voltage ELVSS, and may calculate a difference value between the measured color coordinate value and a fiducial color coordinate value. The color coordinate value repetitive comparison unit may measure a color coordinate value of the organic light-emitting display apparatus 100 under a condition where the level of the second driving voltage ELVSS is decreased by as much as a predetermined change by the voltage level changer 230, and may calculate a difference value between the measured color coordinate value and a fiducial color coordinate value. That is, by utilizing the color coordinate value comparison unit 220 and the voltage level changer 230, the driving voltage determining apparatus 200 may repeatedly measure a color coordinate value of the organic light-emitting display apparatus 100 while decreasing the level of the second driving voltage ELVSS by as much as a predetermined change starting from the second fiducial voltage value, may repeatedly calculate a difference value between the measured color coordinate value and a fiducial color coordinate value, and may repeatedly compare the calculated result and the first critical value to each other.

In this regard, the predetermined change, which is a criterion of changing the level of the second driving voltage ELVSS, may be determined by taking into account both time given to determine a driving voltage and required accuracy of a level of a driving voltage. In an embodiment, when a change in the level of the second driving voltage ELVSS is determined as an overly small value, it may take the voltage level changer 230 too much time to decrease the level of the second driving voltage ELVSS to a level at which no color shift occurs. On the other hand, when the change in the level of the second driving voltage ELVSS is determined as an overly large value, the greatest possible value at the level at which no color shift occurs, which is an ideal numerical value of the level that the second driving voltage ELVSS may have, may not be accurately found. Accordingly, when the accuracy of the level of the second driving voltage ELVSS is important, the change in the level of the second driving voltage ELVSS may be set to be relatively low. When a time period to determine the level of the second driving voltage ELVSS is important, the change in the level of the second driving voltage ELVSS may be set to be relatively high.

When a difference value calculated by the color coordinate value comparing unit 220 is less than a first critical value, the voltage level determiner 240 may determine a level of a driving voltage at a point of time when a corresponding difference value is calculated as a final level of a driving voltage of the organic light-emitting display apparatus 100. That is, when a level of a driving voltage supplied to the organic light-emitting display apparatus 100 is changed by changing a level of the second driving voltage ELVSS, the voltage level determiner 240 may determine a level of the second driving voltage ELVSS at a point of time when a corresponding difference value is calculated as a level of the second driving voltage ELVSS of the organic light-emitting display apparatus 100.

When a difference value calculated by the color coordinate value comparing unit 220 is less than a first critical value, the voltage level determiner 240 may determine a final level of a driving voltage of the organic light-emitting display apparatus 100 by taking into account at least one of a degradation margin and a dispersion margin of the organic light-emitting display apparatus 100 with respect to a level of a driving voltage at a point of time when a corresponding difference value is calculated. In an embodiment, driving characteristics of the organic light-emitting display apparatus 100 may be changed due to factors, such as a length of driving time, a color that pixels included in the organic light-emitting display apparatus 100 each have, and a difference in constituents of the pixels. Also, the driving characteristics of the organic light-emitting display apparatus 100 may be changed due to factors, such as a difference in thickness of an organic layer, a difference in thickness of electrodes, and non-uniformity, which may occur in a process of manufacturing the organic light-emitting display apparatus 100. Accordingly, the voltage level determiner 240 may determine a value obtained by adjusting a level of a driving voltage at a point of time when the color coordinate value comparing unit 220 has calculated the difference value to be a numerical value corresponding to at least one of a degradation margin and a dispersion margin as a final level of the driving voltage.

By using the above-described method, through the initial voltage level setting unit 210, the color coordinate value comparing unit 220, the voltage level changer 230, and the voltage level determiner 240, the driving voltage determining apparatus 200 may determine a driving voltage whereby a defect, such as producing an abnormal color, is prevented or reduced in an organic light-emitting display apparatus, and excessive increase in power consumption to operate the organic light-emitting display apparatus is prevented or reduced. Also, the driving voltage determining apparatus 200 may independently perform a process of determining a level of a driving voltage of each of a plurality of organic light-emitting display apparatuses 100. Thus, a driving voltage that is suitable for each of the organic light-emitting display apparatuses 100 having different features from each other may be determined.

Some or all of the initial voltage level setting unit 210, the color coordinate value comparing unit 220, the voltage level changer 230, and the voltage level determiner 240 may be physical devices that are physically distinct from each other, or may be units that are logically distinct in one physical device. Alternatively, some of the initial voltage level setting unit 210, the color coordinate value comparing unit 220, the voltage level changer 230, and the voltage level determiner 240 may be hardware or software included in the others. Alternatively, some or all of the initial voltage level setting unit 210, the color coordinate value comparing unit 220, the voltage level changer 230, and the voltage level determiner 240 may be logical blocks that are distinct based on an algorithm in a computer program executed by the driving voltage determining apparatus 200.

As shown in FIG. 4, the driving voltage determining apparatus 200 may further include a voltage level recorder 250 and a defect determiner 260. Referring to FIG. 4, the driving voltage determining apparatus 200 may include the initial voltage level setting unit 210, the color coordinate value comparing unit 220, the voltage level changer 230, and the voltage level determiner 240, and may further include the voltage level recorder 250 and the defect determiner 260.

The voltage level recorder 250 may record a level of a driving voltage that is determined by the voltage level determiner 240. For example, the voltage level recorder 250 may record the determined level of the driving voltage on a memory included in the organic light-emitting display apparatus 100. For example, the voltage level recorder 250 may record the determined level of the driving voltage on a register included in one of the controller 110 and the source driver 140. Thus, the driving voltage determining apparatus 200 may allow the organic light-emitting display apparatus 100 to be driven by a driving voltage having the determined level, even when the organic light-emitting display apparatus 100 is separate from the driving voltage determining apparatus 200.

The defect determiner 260 may determine the organic light-emitting display apparatus 100 as defective when the level of the driving voltage that is determined by the voltage level determiner 240 exceeds a second critical value (e.g., a predetermined second critical value). In an embodiment, the organic light-emitting display apparatus 100 may have a defect due to factors such as various external forces that may be applied thereto during a process of manufacturing the organic light-emitting display apparatus 100, a process of testing the organic light-emitting display apparatus 100, a process of transporting the organic light-emitting display apparatus 100, and/or the like. When the level of the driving voltage that is determined by the voltage level determiner 240 shows an excessively large difference from that of an ideal numerical value, the defect determiner 260 may determine that a defect has occurred in the organic light-emitting display apparatus 100. Thus, the driving voltage determining apparatus 200 may determine, in advance, that the organic light-emitting display apparatus 100 has a defect, and thus, the defective product may not be sent to a buyer.

Some or all of the initial voltage level setting unit 210, the color coordinate value comparing unit 220, the voltage level changer 230, the voltage level determiner 240, the voltage level recorder 250, and the detect determiner 260 may be physical devices that are physically distinct from each other, or may be units that are logically distinct in one physical device. Alternatively, some of the initial voltage level setting unit 210, the color coordinate value comparing unit 220, the voltage level changer 230, the voltage level determiner 240, the voltage level recorder 250, and the detect determiner 260 may be hardware or software included in the others. Alternatively, some or all of the initial voltage level setting unit 210, the color coordinate value comparing unit 220, the voltage level changer 230, the voltage level determiner 240, the voltage level recorder 250, and the detect determiner 260 may be logical blocks that are distinct based on an algorithm in a computer program executed by the driving voltage determining apparatus 200.

Figure 5:
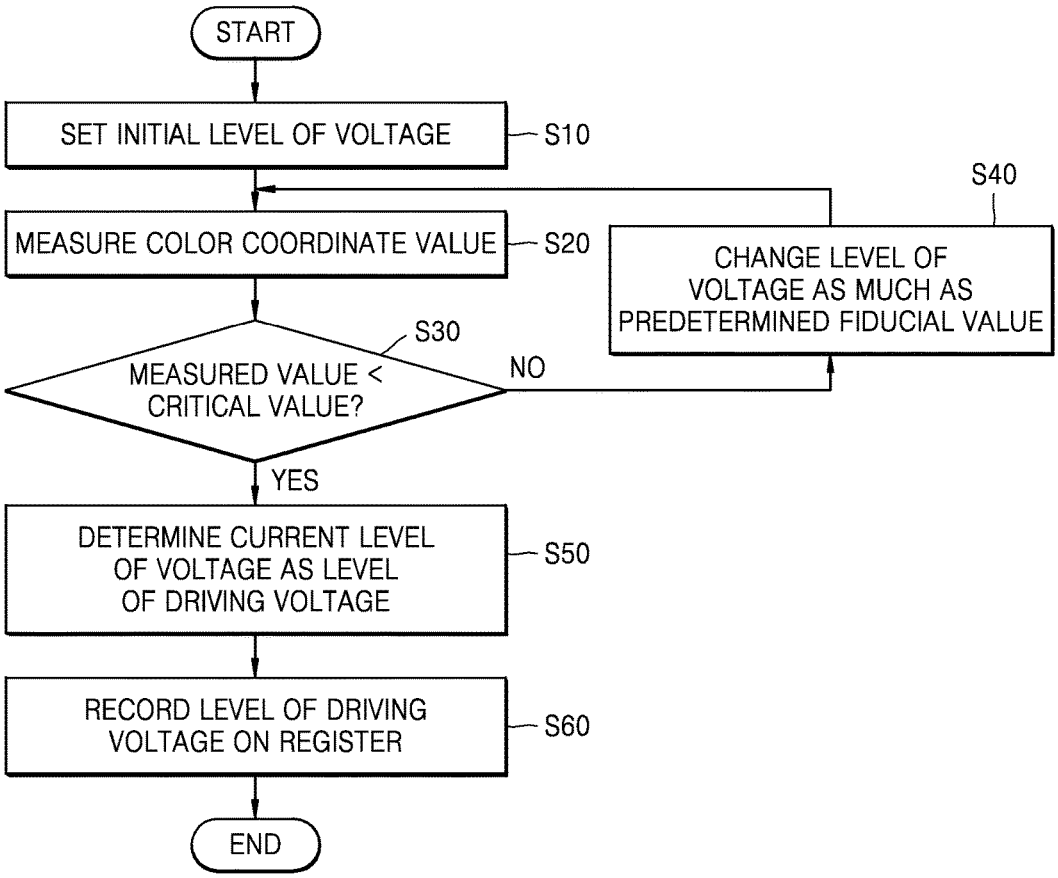
FIG. 5 is a flowchart schematically illustrating an example of a method of determining a driving voltage of an organic light-emitting display apparatus by using a method of determining a driving voltage, according to an exemplary embodiment.

FIG. 5 is a flowchart schematically illustrating an example of a method of determining a driving voltage of the organic light-emitting display apparatus 100 by using a method of determining a driving voltage, according to an exemplary embodiment.

The flowchart of FIG. 5 includes operations processed in time series by the driving voltage determining apparatus 200 illustrated in FIG. 3 and/or FIG. 4. Accordingly, although repeated descriptions may be omitted below, the above descriptions of configurations illustrated in FIG. 3 and/or FIG. 4 may be applied to the flowchart of FIG. 5 as well.

Referring to FIG. 5, the method of determining a driving voltage, according to an exemplary embodiment, may include setting an initial level of a voltage (operation S10), measuring a color coordinate value (operation S20), comparing the measured color coordinate value with a critical value (operation S30), changing the level of a voltage as much as a fiducial value (e.g., a predetermined fiducial value) when the measured color coordinate value is greater than or equal to the critical value (operation S40), determining a current level of a voltage as a level of a driving voltage when the measured color coordinate value is less than the critical value (operation S50), and recording the level of a driving voltage on a register (operation S60).

In the setting of the initial level of the voltage (operation S10), a first fiducial voltage value (e.g., a predetermined first fiducial voltage value) may be set as an initial level of a driving voltage of the organic light-emitting display apparatus 100, and a voltage level of a data signal supplied to the pixels P may be adjusted, such that a color coordinate value of the organic light-emitting display apparatus 100 is identical to or substantially the same as a fiducial color coordinate value. In this regard, in the setting of the initial level of the voltage (operation S10), a second fiducial voltage value (e.g., a second predetermined second fiducial voltage value) may be set as a level of the driving voltage of the organic light-emitting display apparatus 100 under a condition where the color coordinate value of the organic light-emitting display apparatus 100 is set to be identical to or substantially the same as the fiducial color coordinate value.

In the measuring of the color coordinate value (operation S20), a color coordinate value of the organic light-emitting display apparatus 100 may be measured, and a difference value between the measured color coordinate value and a fiducial color coordinate value may be calculated. In this regard, the measuring of the color coordinate value (operation S20) may include measuring a color coordinate value of the organic light-emitting display apparatus 100 under a condition where the second fiducial voltage value is set as the level of the driving voltage of the organic light-emitting display apparatus 100, and measuring a color coordinate value of the organic light-emitting display apparatus 100 under a condition where the level of the driving voltage is changed by the changing of the level of the voltage (operation S40).

In the comparing of the measured color coordinate value with the critical value (operation S30), the calculated difference value may be compared with a first critical value (e.g., a first predetermined critical value).

When the measured color coordinate value is greater than or equal to the critical value, in the changing of the level of the voltage (operation S40), a level of a driving voltage applied, in order to supply driving current to the pixels P of the organic light-emitting display apparatus 100, of each of the pixels P may be changed by as much as a predetermined change.

When the measured color coordinate value is less than the critical value, in the determining of the current level of the voltage as a level of the driving voltage (operation S50), a level of a driving voltage at a point of time when the difference value is calculated may be determined as a final level of a driving voltage of the organic light-emitting display apparatus 100. Also, in the determining of the current level of the voltage as a level of the driving voltage (operation S50), the level of the driving voltage at the point of time when the difference value is calculated may be modified by taking into account at least one of a degradation margin and a dispersion margin of the organic light-emitting display apparatus 100, and the modified level of a voltage may be determined as the final level of the driving voltage of the organic light-emitting display apparatus 100.

In the recording of the level of the driving voltage (operation S60), a level of a driving voltage determined in the determining of the current level of the voltage as a level of the driving voltage (operation S50) may be recorded on the register included in the organic light-emitting display apparatus 100.

Also, the method of determining a driving voltage, according to an exemplary embodiment, may further include, after the determining operation (operation S50), determining that the organic light-emitting display apparatus 100 having the determined level of the driving voltage is defective, when the determined level of the driving voltage is higher than a second critical value (e.g., a predetermined second critical value.

According to one or more exemplary embodiments, an apparatus and method of determining a driving voltage whereby a defect, such as producing an abnormal color, is prevented or substantially prevented in an organic light-emitting display apparatus, and/or excessive increase in power consumption to operate the organic light-emitting display apparatus is prevented or substantially prevented, is provided.

According to one or more exemplary embodiments, an apparatus and method of determining a driving voltage, wherein a degree to which a color coordinate value changes according to a change in a level of a driving voltage applied to an organic light-emitting display apparatus is measured to prevent or reduce a defect, such as producing an abnormal color, in the organic light-emitting display apparatus, and to prevent or substantially prevent excessive increase in power consumption to operate the organic light-emitting display apparatus, is provided.

Operations of all methods described herein may be performed in any suitable order, unless otherwise indicated herein, or otherwise clearly contradicted by context. One or more exemplary embodiments are not necessarily limited according to an order in which the operations are recited herein. The use of any and all examples or exemplary language (e.g., "such as") provided herein is intended merely to better illuminate the inventive concept, and is not intended to limit the scope of the inventive concept, unless otherwise claimed. Various modifications and adaptations will be readily apparent to those of ordinary skill in the art without departing from the spirit and scope of the inventive concept.

It should be understood that exemplary embodiments described herein should be considered in a descriptive sense only and not for purposes of limitation. Descriptions of features or aspects within each exemplary embodiment should typically be considered as available for other similar features or aspects in other exemplary embodiments.

While one or more exemplary embodiments have been described with reference to the figures, it will be understood by those of ordinary skill in the art that various changes in form and details may be made therein, without departing from the spirit and scope of the present invention as defined by the following claims, and their equivalents.

What is claimed is:

1. An apparatus for determining a driving voltage, the apparatus comprising:

a color coordinate value comparator configured to measure a color coordinate value of an organic light-emitting display apparatus, to calculate a difference value between the measured color coordinate value and a fiducial color coordinate value, and to compare the calculated difference value with a first critical value;

a voltage level changer configured to increase an absolute value of a driving voltage applied to each pixel of the organic light-emitting display apparatus when the difference value is greater than or equal to the first critical value, in order to supply driving current to the pixels; and a voltage level determiner configured to determine a level of the driving voltage at a point of time when the difference value is calculated as a final level of the driving voltage of the organic light-emitting display apparatus, when the difference value is less than the first critical value.

2. The apparatus of claim 1, further comprising an initial voltage level setter configured to set a first fiducial voltage value as an initial level of the driving voltage of the organic light-emitting display apparatus, and to adjust a voltage level of a data signal supplied to the pixels such that the color coordinate value of the organic light-emitting display apparatus is the same as the fiducial color coordinate value.

3. The apparatus of claim 2, wherein the initial voltage level setter is configured to set a second fiducial voltage value as a level of the driving voltage of the organic light-emitting display apparatus when the color coordinate value of the organic light-emitting display apparatus is set to be the same as the fiducial color coordinate value.

4. The apparatus of claim 3, wherein the color coordinate value comparator comprises:

a color coordinate value initial comparator configured to measure a color coordinate value of the organic light-emitting display apparatus when the second fiducial voltage value is set as the level of the driving voltage of the organic light-emitting display apparatus; and a color coordinate value repetitive comparator configured to measure a color coordinate value of the organic light-emitting display apparatus when the level of the driving voltage is changed by the voltage level changer.

5. The apparatus of claim 1, wherein the voltage level determiner is further configured to modify the level of the driving voltage at a point of time when the difference value is calculated by taking into account at least one of a degradation margin and a dispersion margin of the organic light-emitting display apparatus, and to determine the modified level of the driving voltage as the final level of the driving voltage of the organic light-emitting display apparatus, when the difference value is less than the first critical value.

6. The apparatus of claim 5, wherein the voltage level determiner is further configured to determine the degradation margin by taking into account at least one of a length of time during which the organic light-emitting display apparatus is driven, a color of each of the pixels of the organic light-emitting display apparatus, and a constituent of each of the pixels of the organic light-emitting display apparatus.

7. The apparatus of claim 5, wherein the voltage level determiner is further configured to determine the dispersion margin by taking into account at least one of a thickness of an organic layer of the organic light-emitting display apparatus, a thickness of an electrode of the organic light-emitting display apparatus, and a process of manufacturing the organic light-emitting display apparatus.

8. The apparatus of claim 1, further comprising a voltage level recorder configured to record the determined level of the driving voltage on a register of a source driver of the organic light-emitting display apparatus.

9. The apparatus of claim 1, further comprising a defect determiner configured to determine that the organic light-emitting display apparatus is defective, when the determined level of the driving voltage is higher than a second critical value.

10. The apparatus of claim 1, wherein the organic light-emitting display apparatus comprises a plurality of organic light-emitting display apparatuses, and the voltage level determiner is configured to determine a level of the driving voltage independently for each of the organic light-emitting display apparatuses.

11. A method of determining a level of a driving voltage of an organic light-emitting display apparatus, the method comprising:

measuring a color coordinate value of the organic light-emitting display apparatus;

calculating a difference value between the measured color coordinate value and a fiducial color coordinate value;

comparing the calculated difference value with a first critical value;

increasing an absolute value of the driving voltage applied to each pixel of the organic light-emitting display apparatus, when the difference value is equal to or greater than the first critical value, in order to supply driving current to the pixels; and determining a level of the driving voltage at a point of time when the difference value is calculated as a final level of the driving voltage of the organic light-emitting display apparatus, when the difference value is less than the first critical value.

12. The method of claim 11, further comprising setting a first fiducial voltage value as an initial level of the driving voltage of the organic light-emitting display apparatus before the comparing of the calculated difference value with the first critical value, and adjusting a voltage level of a data signal supplied to the pixels such that the color coordinate value of the organic light-emitting display apparatus is the same as the fiducial color coordinate value.

13. The method of claim 12, wherein the adjusting of the voltage level of the data signal supplied to the pixels comprises setting a second fiducial voltage value as a level of the driving voltage of the organic light-emitting display apparatus when the color coordinate value of the organic light-emitting display apparatus is set to be the same as the fiducial color coordinate value.

14. The method of claim 13 wherein the measuring of the color coordinate value of the organic light-emitting display apparatus further comprises:

measuring a color coordinate value of the organic light-emitting display apparatus when the second fiducial voltage value is set as the level of the driving voltage of the organic light-emitting display apparatus; and measuring a color coordinate value of the organic light-emitting display apparatus when the level of the driving voltage is changed by the increasing of the absolute value of the driving voltage.

15. The method of claim 11, wherein the determining of the level of the driving voltage comprises:

modifying the level of the driving voltage at the point of time when the difference value is calculated by taking into account at least one of a degradation margin and a dispersion margin of the organic light-emitting display apparatus; and determining the modified level of the driving voltage as the final level of the driving voltage of the organic light-emitting display apparatus.

16. The method of claim 15, wherein the determining of the level of the driving voltage further comprises determining the degradation margin by taking into account at least one of a length of time during which the organic light-emitting display apparatus is driven, a color of each of the pixels of the organic light-emitting display apparatus, and a constituent of each of the pixels of the organic light-emitting display apparatus.

17. The method of claim 15, wherein the determining of the level of the driving voltage further comprises determining the dispersion margin by taking into account at least one of a thickness of an organic layer of the organic light-emitting display apparatus, a thickness of an electrode of the organic light-emitting display apparatus, and a process of manufacturing the organic light-emitting display apparatus.

18. The method of claim 11, further comprising recording the determined level of the driving voltage on a register of a source driver of the organic light-emitting display apparatus, after the determining of the level of the driving voltage.

19. The method of claim 11, further comprising determining that the organic light-emitting display apparatus is defective after the determining of the level of the driving voltage, when the determined level of the driving voltage is higher than a second critical value.

20. The method of claim 11, wherein the determining of the level of the driving voltage comprises determining the level of the driving voltage independently for each of a plurality of organic light-emitting display apparatuses.

* * * * *